US008490232B2

(12) United States Patent
Haffner et al.

(10) Patent No.: US 8,490,232 B2
(45) Date of Patent: Jul. 23, 2013

(54) SPRING CORE HAVING BORDER WIRE WITH GENERALLY RECTANGULAR CROSS-SECTION

(75) Inventors: David S. Haffner, Carthage, MO (US); John E. Hull, Monett, MO (US); Steven M. Montague, Carthage, MO (US); Darrell A. Richmond, Carthage, MO (US); Thomas W. Wells, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 340 days.

(21) Appl. No.: 12/821,754

(22) Filed: Jun. 23, 2010

(65) Prior Publication Data

US 2011/0314613 A1 Dec. 29, 2011

(51) Int. Cl.
*A47C 23/04* (2006.01)

(52) U.S. Cl.
USPC ..... 5/717; 5/716

(58) Field of Classification Search
USPC ..... 5/716, 717
See application file for complete search history.

(56) References Cited

U.S. PATENT DOCUMENTS

| | | | | | |
|---|---|---|---|---|---|
| 2,105,923 | A | * | 1/1938 | Marsack | 5/717 |
| 2,235,538 | A | * | 3/1941 | Schob | 5/717 |
| 2,244,543 | A | * | 6/1941 | Herrmann | 5/716 |
| 2,319,431 | A | * | 5/1943 | Owen | 5/717 |
| 2,336,975 | A | | 12/1943 | Asaro | |
| 2,885,693 | A | | 5/1959 | Wuest | |
| 2,978,714 | A | * | 4/1961 | Bechik | 5/717 |
| 3,173,159 | A | * | 3/1965 | Hart | 5/717 |
| RE25,951 | E | | 12/1965 | Nachman, Jr. | |
| 3,737,929 | A | | 6/1973 | Golembeck | |
| 3,756,167 | A | | 9/1973 | Wilson | |
| 3,914,809 | A | | 10/1975 | Ciampa et al. | |
| 4,245,362 | A | * | 1/1981 | Mueller | 5/678 |
| 4,245,363 | A | * | 1/1981 | Callaway | 5/678 |
| 4,348,014 | A | | 9/1982 | Litkewycz | |
| 4,424,600 | A | * | 1/1984 | Callaway | 5/710 |
| 4,435,864 | A | * | 3/1984 | Callaway | 5/706 |
| 4,449,261 | A | * | 5/1984 | Magnusson | 5/722 |
| 4,470,584 | A | | 9/1984 | Mizelle | |
| 5,052,064 | A | | 10/1991 | Hagemeister et al. | |
| 5,062,172 | A | | 11/1991 | Stewart | |
| 5,361,434 | A | | 11/1994 | Hagemeister et al. | |
| 5,418,989 | A | | 5/1995 | Roe | |
| 5,471,688 | A | * | 12/1995 | Cavazos | 5/251 |
| 5,485,639 | A | * | 1/1996 | Cavazos | 5/259.1 |
| 5,636,396 | A | * | 6/1997 | Workman et al. | 5/717 |
| 5,652,986 | A | * | 8/1997 | Wells | 5/716 |
| 5,787,532 | A | * | 8/1998 | Langer et al. | 5/717 |
| 5,860,200 | A | * | 1/1999 | Wells et al. | 24/703.1 |

(Continued)

*Primary Examiner* — Robert G Santos
*Assistant Examiner* — David E Sosnowski
(74) *Attorney, Agent, or Firm* — Wood, Herron & Evans, LLP

(57) ABSTRACT

A bedding or seating product comprising a spring core including at least one border wire and a plurality of coil springs. Each of the border wires is generally rectangular in cross-section to reduce wire costs without compromising beam strength of the border wire. Each of the coil springs may be made of a single piece of wire having a central spiral portion defining a central spring axis and terminating at opposed ends with upper and lower end turns. The coil springs may be arranged in side-by-side rows and columns and be connected with each other at the upper and lower end turns by helical lacing wires.

19 Claims, 4 Drawing Sheets

U.S. PATENT DOCUMENTS

| | | | | |
|---|---|---|---|---|
| 6,149,143 | A * | 11/2000 | Richmond et al. | 267/92 |
| 6,158,071 | A * | 12/2000 | Wells | 5/717 |
| 6,202,238 | B1 * | 3/2001 | Mossbeck et al. | 5/717 |
| 7,237,282 | B2 | 7/2007 | Beck et al. | |
| 7,251,847 | B2 * | 8/2007 | Wells | 5/716 |
| 7,386,897 | B2 | 6/2008 | Eigenmann et al. | |
| 7,870,626 | B2 * | 1/2011 | Antinori | 5/717 |
| 7,921,561 | B2 * | 4/2011 | Eigenmann et al. | 29/896.92 |
| 2004/0128771 | A1 | 7/2004 | Wells | |
| 2007/0094807 | A1 | 5/2007 | Wells | |
| 2008/0115287 | A1 | 5/2008 | Eigenmann et al. | |
| 2010/0175185 | A1 | 7/2010 | Davis et al. | |
| 2010/0295223 | A1 * | 11/2010 | Eigenmann et al. | 267/166 |
| 2010/0299839 | A1 * | 12/2010 | Eigenmann et al. | 5/655.7 |
| 2011/0314601 | A1 * | 12/2011 | Haffner et al. | 5/247 |
| 2011/0314613 | A1 * | 12/2011 | Haffner et al. | 5/720 |
| 2012/0110732 | A1 * | 5/2012 | Haffner et al. | 5/247 |
| 2012/0204426 | A1 * | 8/2012 | Eigenmann et al. | 29/896.92 |

* cited by examiner

SPRING CORE HAVING BORDER WIRE WITH GENERALLY RECTANGULAR CROSS-SECTION

BACKGROUND OF THE INVENTION

This invention relates generally to bedding or seating products, and more particularly, to a spring core for a mattress.

Traditionally, spring cores for mattresses have consisted of a plurality of spaced parallel rows of helical coil springs mounted between border wires; coil springs adjacent the border wires being attached thereto via helical lacing wires, sheet metal clips or other connectors. The upper and lower end turns of adjacent coil springs are generally connected to each other by helical lacing wires. Coil springs are arranged in longitudinally extending columns and transversely extending rows. Padding and upholstery commonly are secured to opposed surfaces of the spring core, thereby resulting in what is known in the industry as a two-sided mattress for use on either side.

Recently, spring cores have been developed having only one border wire to which the end turns of the outermost coil springs are secured. After padding and/or other materials are placed over the upper surface of the spring core in which the border wire is located, an upholstered covering is sewn or secured around the spring core and cushioning materials, thereby creating what is known in the industry as a one-sided or single-sided mattress.

The upper and lower end turns of unknotted coil springs often are made with portions or legs which abut one another when coil springs are placed next to each other. Adjacent coil springs are connected to each other at their end turns with helical lacing wire. One leg of an end turn of a coil spring is set beside the opposite leg of an end turn of the adjacent coil spring. The side-by-side legs are laced together with helical lacing wire.

The greatest expense in manufacturing spring cores or assemblies is the cost of the raw material, the cost of the steel used to make the coil springs which are assembled together. For many years, the wire from which unknotted coil springs have been manufactured has a tensile strength no greater than 290,000 psi. This standard wire, otherwise known as AC&K (Automatic Coiling and Knotting) grade wire has a tensile strength on the order of 220,000 to 260,000 and is thicker, i.e., has a greater diameter, than high tensile strength wire, i.e., wire having a tensile strength greater than 265,000 psi. In order to achieve the same resiliency or bounce back, a coil spring made of standard gauge wire must have one half an additional turn when compared to a coil spring made of high tensile wire. In other words, the pitch of the coil springs made of high tensile wire may be greater as compared to coil springs made of standard wire. Coil springs made of high tensile strength wire also do not tend to set or permanently deform when placed under significant load for an extended period of time, i.e., during shipping. Therefore, there is a desire in the industry to make coil springs having unknotted end turns of high tensile strength wire because less wire is necessary to manufacture each coil spring.

U.S. Pat. No. 7,386,897 discloses a bedding or seating product having a spring core made of high tensile strength wire. However, each of the spring cores disclosed in this patent has at least one border wire having a round cross-sectional configuration.

The border wire of these and other known spring cores is often six-gauge, having a diameter of 0.191 inches. To make a border wire having the same beam strength but made from a smaller diameter wire, say seven-gauge wire having a diameter of 0.176 inches, would save material and therefore reduce the end cost of the innerspring or spring core. In order to achieve the same beam strength, the seven-gauge border wire must be changed or shaped from a circular cross-section to a rectangular cross-section in accordance with the present invention. Thus, the present invention enables one to use a seven-gauge wire rather than a six-gauge wire in the border wire of the spring core and therefore, reduce wire cost without giving up any beam strength.

In order to achieve cost savings, it would be desirable to reduce the cross sectional area of the border wire of a spring core (by creating the border wire from a smaller diameter wire) while maintaining the same beam strength or increasing it. Therefore, making a spring core having at least one border wire with a rectangular cross-section would result in cost savings for the manufacturer of the spring core.

SUMMARY OF THE INVENTION

This invention provides the desirable cost savings in wire without compromising the integrity of the spring cores of bedding or seating products. In one embodiment, the bedding or seating product comprises a spring core or spring assembly made up of upper and lower border wires and a plurality of coil springs joined together with helical lacing wire. Padding overlies the spring assembly and a fabric covering encases the padding and spring assembly.

In one embodiment, the spring assembly includes upper and lower generally rectangular border wires having two parallel sides and two parallel ends. The border wire has a generally rectangular cross-sectional configuration with the height being greater than the width of the cross-section. The spring assembly further comprises a plurality of coil springs, each of the coil springs being made of a single piece of wire having a central spiral portion defining a central spring axis and terminating at opposed ends with upper and lower end turns. The coil springs are arranged in side-by-side rows and columns and are connected with each other at the upper and lower end turns by helical lacing wires. The end turns of the coil springs may be unknotted or knotted (known in the industry as Bonnell springs).

In another embodiment, the spring assembly includes only one generally rectangular border wire having two parallel sides and two parallel ends. The border wire has a generally rectangular cross-sectional configuration with the height being greater than the width of the cross-section. The spring assembly further comprises a plurality of coil springs, each of the coil springs being made of a single piece of wire having a central spiral portion defining a central spring axis and terminating at opposed ends with upper and lower end turns. The coil springs are arranged in side-by-side rows and columns and are connected with each other at the upper and lower end turns by helical lacing wires. The end turns of the coil springs may be unknotted or knotted (known in the industry as Bonnell springs).

In another embodiment, the spring assembly includes a plurality of parallel, pocketed strings of springs secured together. Each of the strings of springs comprises a row of interconnected pockets, each of the pockets containing at least one coil spring encased in fabric. The product further comprises upper and lower generally rectangular border wires having two parallel sides and two parallel ends. The border wire has a generally rectangular cross-sectional configuration with the height being greater than the width of the cross-section.

Each border wire of each of the spring assemblies of this invention has a unique cross-sectional configuration which enables the border wire to be made of a larger gauge, smaller diameter wire than heretofore known in art without comprising the beam strength of the border wire when compared to prior art border wires having a round cross-sectional configuration. The smaller diameter wire, when reshaped from a circular cross-section into a rectangular cross-section, has the same cross-sectional area as when it had a circular cross-section. One advantage of this invention is that it enables a bedding or seating spring core or spring assembly having at least one border wire to be made using less steel or material, thereby reducing the ultimate cost of the product to the product's assembler.

In addition to reducing the quantity of wire necessary to manufacture a spring core for use in a bedding or seating product, the unique shape of the border wire of the present invention provides a secure connection between the end turns of the springs and the border wire.

Although several types of spring cores have been described, the present border wire may be used in any bedding or seating product. For example, individually pocketed coil springs may be used rather than convention coil springs, the pocketed coil springs being clipped to the unique border wire or wires of this invention.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
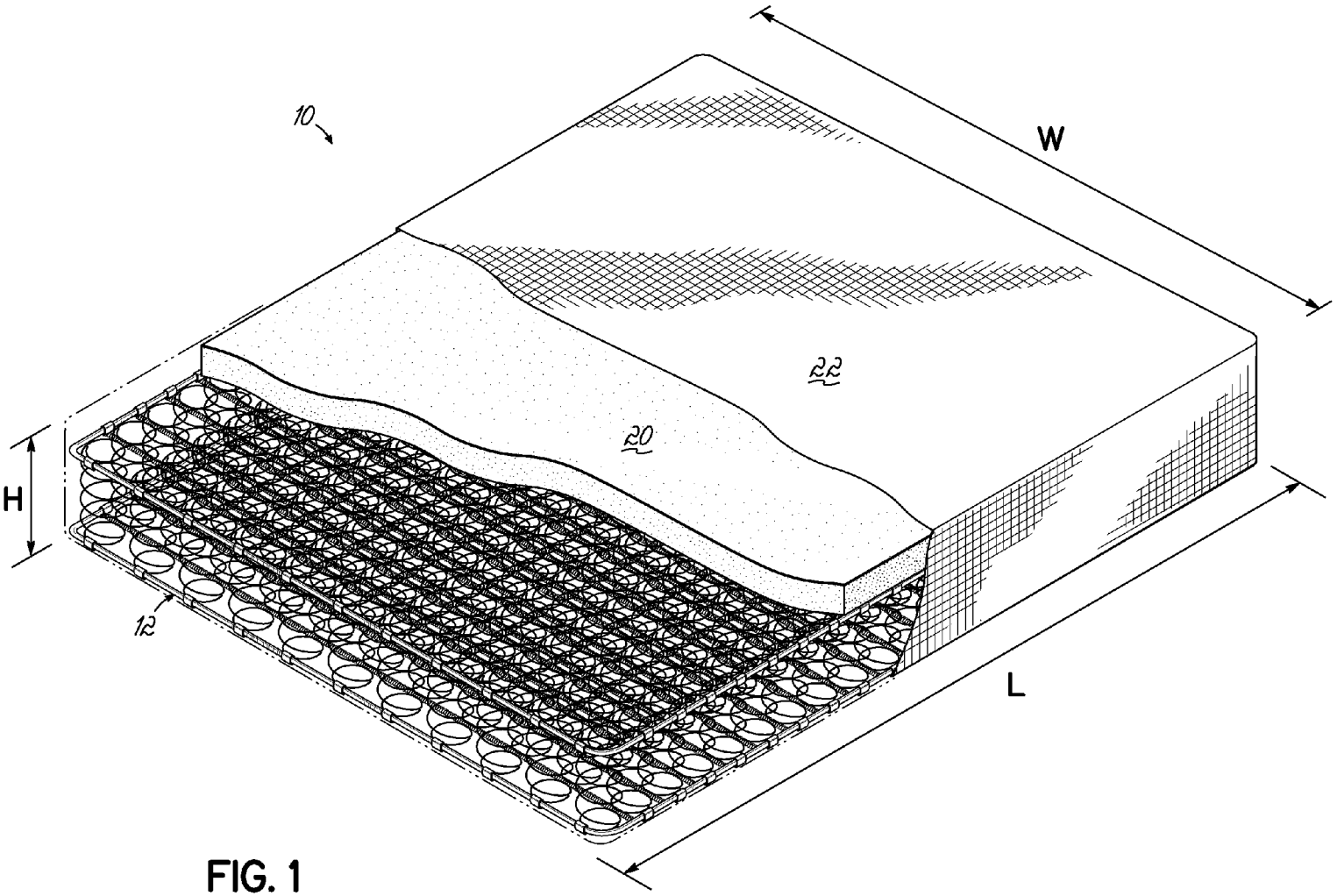
FIG. 1 is a perspective view, partially broken away, of a mattress according to one embodiment.

Referring to the drawings and, particularly to FIG. 1, a bedding or seating product in the form of a mattress 10, according to one embodiment of this invention, is illustrated. As shown in FIG. 1, the mattress 10 has a longitudinal dimension or length L, a transverse dimension or width W and a height H. Although the length L is shown as being greater than the width W, they may be identical.

The mattress 10 comprises a spring core or spring assembly 12 comprising a plurality of aligned coil springs 14 held together with helical lacing wires 16 and upper and lower border wires 17, 18. Padding 20 overlies the spring assembly 12, and a fabric covering 22 surrounds the padding 20 and spring assembly 12.

Figure 2:
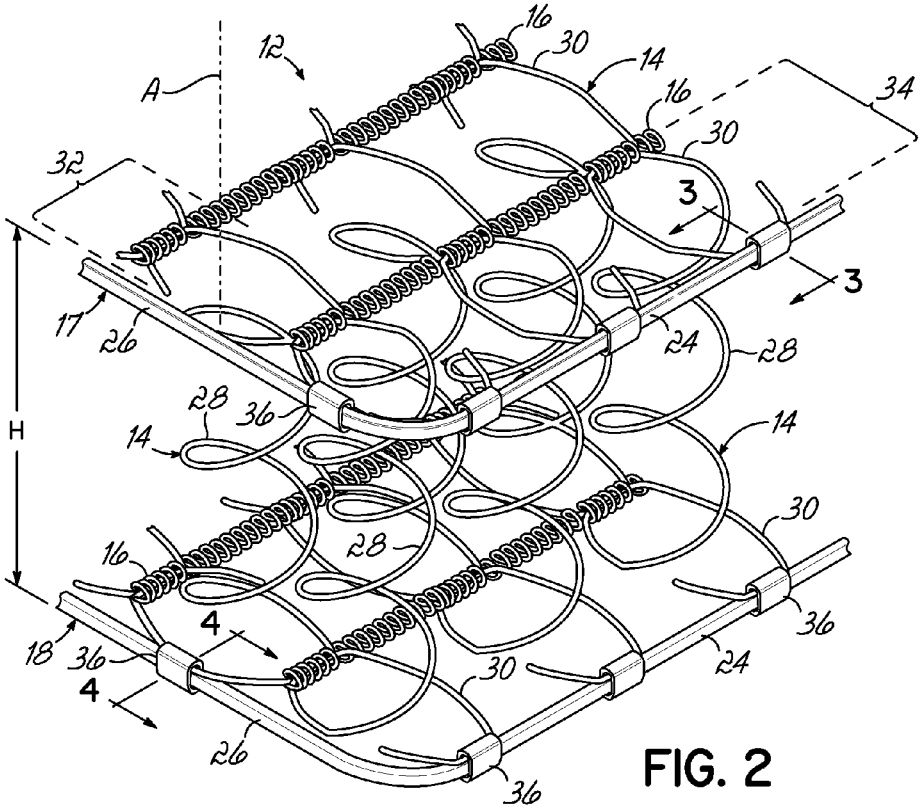
FIG. 2 is an enlarged perspective view illustrating a portion of the mattress of FIG. 1.

FIG. 2 illustrates a two-sided spring assembly 12 having upper and lower generally rectangular steel border wires 17, 18. Each border wire has two parallel sides 24, 24 and two parallel ends 26, 26. The parallel sides 24, 24 are longer than the parallel ends 26, 26 in the embodiment illustrated. However, they may be the same size.

Each of the coil springs 14 is made of one piece of wire having a central spiral portion 28 defining a central spring axis A and terminating at opposed ends with upper and lower unknotted end turns 30. The coil springs 14 are arranged in side-by-side rows 32 and columns 34. The coil springs 14 are connected with each other by helical lacing wires 16. More particularly, the end turns 30 of the coil springs 14 are joined together using the helical lacing wires 16, as is known in the art. Although the helical lacing wires 16 are shown as extending parallel the sides 24 of the border wires 17, 18, they may extend parallel the ends 26 of the border wires. In other words, different orientations of the coil springs and helical lacing wires within the spring core are possible within the scope of the present invention.

Figure 3:
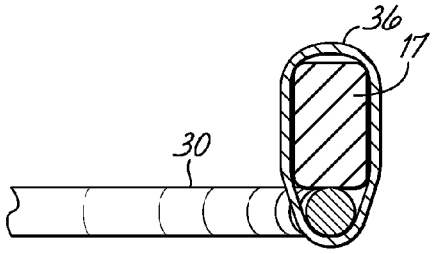
FIG. 3 is a cross-sectional view taken along the line 3-3 of FIG. 2.
Figure 4:
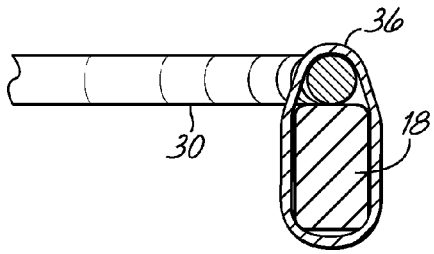
FIG. 4 is a cross-sectional view taken along the line 4-4 of FIG. 2.

As shown in FIG. 2, the upper end turns 30 of the outermost coil springs 14 of the spring core 12 are clipped to the upper border wire 17 by clips 36. As shown in FIG. 3, the upper end turns 30 of the outermost coil springs 14 are positioned below the upper border wire 17. The upper border wire 17 is clipped to the upper end turns 30 of the outermost coil springs by clips 36. One of the clips 36 surrounds one of the upper end turns 30 of one of the outermost coil springs 14 and the upper border wire 17 at a predetermined, desired position, as shown in FIG. 3. As shown in FIG. 4, the lower end turns 30 of the outermost coil springs 14 are positioned above the lower border wire 18. One of the clips 36 surrounds one of the lower end turns 30 of one of the outermost coil springs 14 and the lower border wire 18 at a predetermined, desired position.

The spring assembly 12 of mattress 10 is generally manufactured by a supplier, who then ships it to an assembler. The assembler adds to the spring assembly 12 padding 20, and covers the components with upholstery 22 to make a completed product.

Figure 6:
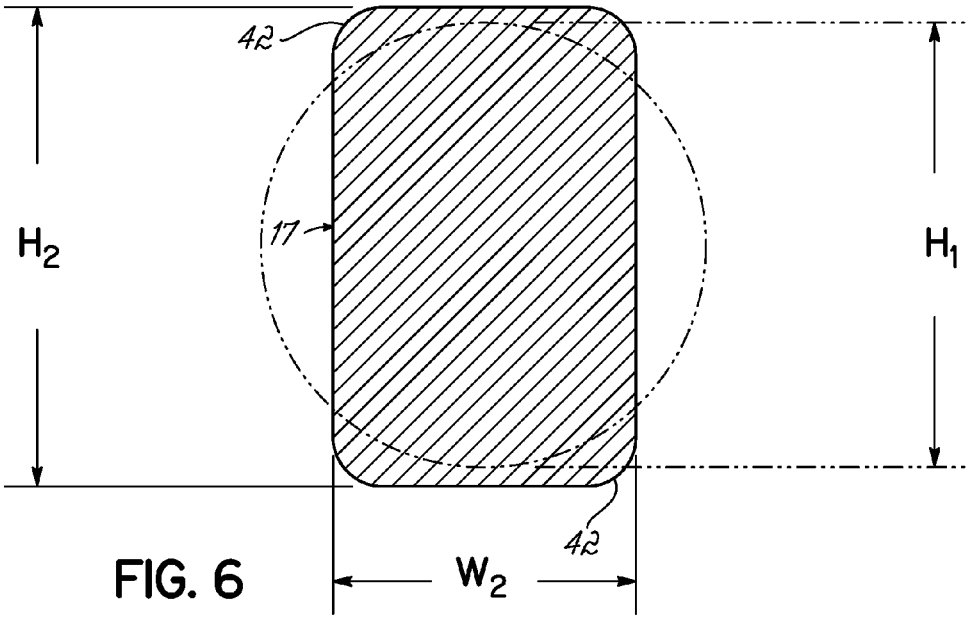
FIG. 6 is a cross sectional view illustrating the border wire of the present invention.

One advantage of the spring assembly 12 and associated bedding or seating product, such as mattress 10 according to this invention, is that each of the border wires 17, 18 is uniquely configured to enable the border wire to be made of a lesser gauge, smaller diameter wire than existing border wires without giving up any strength. In the embodiments of mattress 10 and associated spring assembly 12 shown in FIGS. 1-4 and 6 of the drawings, each of the border wires 17, 18 has a rectangular cross-sectional configuration. The upper border wire 17 is shown and described in FIG. 6, although each of the border wires of each of the embodiments illustrated or described herein may be identical to upper border wire 17. As shown in FIG. 6, the height $H_2$ of border wire 17 is greater than the width $W_2$ of the border wire 17.

Figure 5:
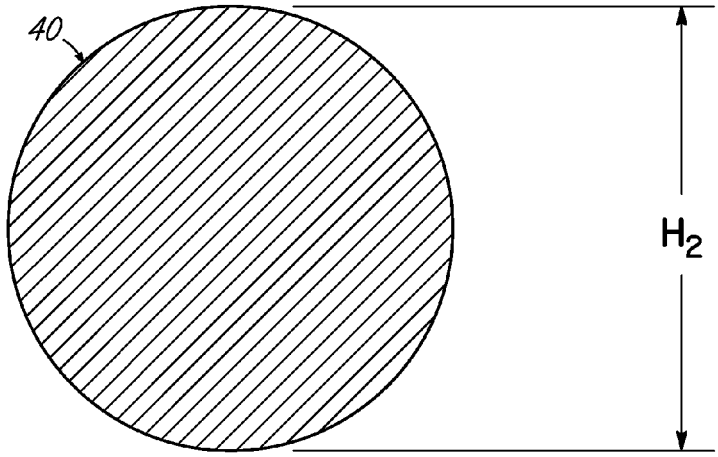
FIG. 5 PRIOR ART
FIG. 5 is a cross sectional view illustrating prior art.

FIG. 5 illustrates a cross-section of a prior art border wire 40 made of six-gauge wire. The cross-section is round and has a diameter of $H_2$ (0.191 inches in the case of six-gauge wire).

FIG. 6 illustrates a rectangular cross-section of the upper border wire 17 of mattress 10. Lower border wire 18 of mattress 10 is identical to upper border wire 17. The upper border wire 17 is reshaped into a rectangular cross section from a seven-gauge wire having a round cross section (shown in dashed lines in FIG. 6) having a diameter of $H_1$, which is less than the diameter $H_2$ of the six-gauge wire shown in FIG. 5. In the example, $H_1$ is 0.176 inches and $H_2$ is 0.191 inches. The cross-section of border wire 17 shown in FIG. 6 is rectangular and has a height of $H_2$ (0.191 inches, same as the diameter of the six-gauge wire shown in FIG. 5) and a width of 0.120 inches. Thus, in switching from a six-gauge wire having a round cross-section to a seven-gauge wire having a rectangular cross-section, no height is lost. In changing the shape of the border wire 17 from a round cross-section to a rectangular cross-section, the cross-sectional area remains approximately identical. The generally rectangular cross-section of border wire has rounded corners 42 as shown in FIG. 6.

Figure 2A:
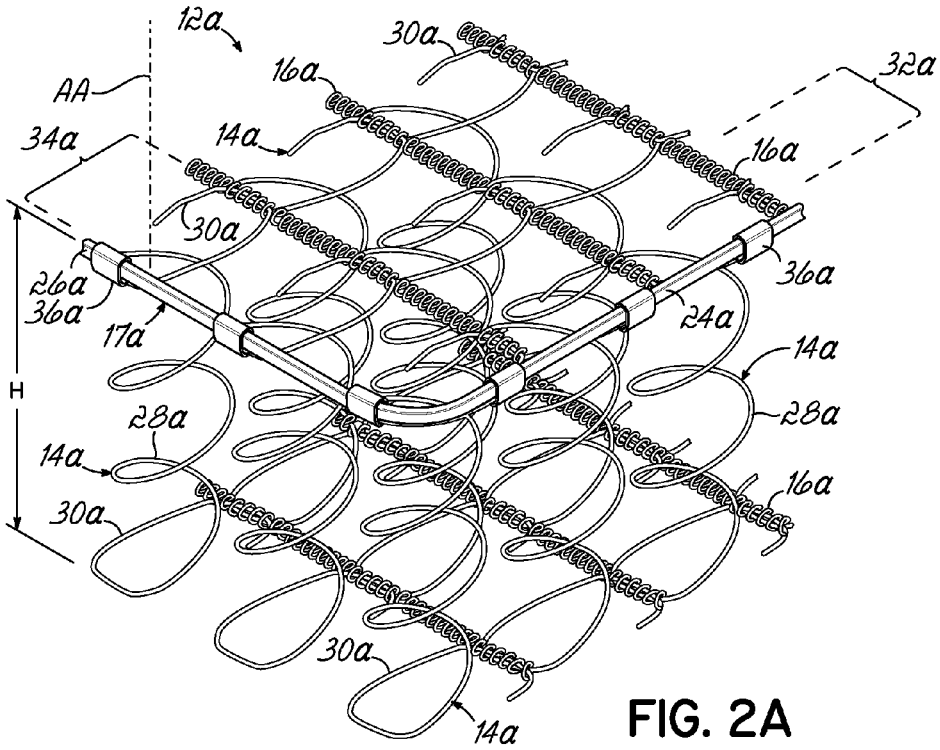
FIG. 2A is an enlarged perspective view of a portion of an alternative embodiment of spring core in accordance with the present invention.

FIG. 2A illustrates a one-sided spring assembly 12*a* having only an upper border wire 17*a* and no lower border wire. Border wire 17*a* is configured and sized like the border wires 17, 18. Each of the coil springs 14*a* of spring core 12*a* is made of one piece of wire having a central spiral portion 28*a* defining a central spring axis AA and terminating at opposed ends with upper and lower unknotted end turns 30*a*. The coil springs 14*a* are arranged in side-by-side rows 32*a* and columns 34*a*. The coil springs 14*a* are connected with each other by helical lacing wires 16*a*. More particularly, the end turns 30*a* of the coil springs 14*a* are joined together using the helical lacing wires 16*a*, as is known in the art. Although the helical lacing wires 16*a* are shown as extending parallel, the ends 26*a* of the border wire 17*a* they may extend parallel the sides 24 of the border wire. In other words, different orientations of the coil springs and helical lacing wires within the spring core 12*a* are possible within the scope of the present invention. As shown in FIG. 2A, the upper end turns 30*a* of the outermost coil springs 14*a* of the spring core 12*a* are clipped to the upper border wire 17*a* by clips 36*a*.

Figure 7:
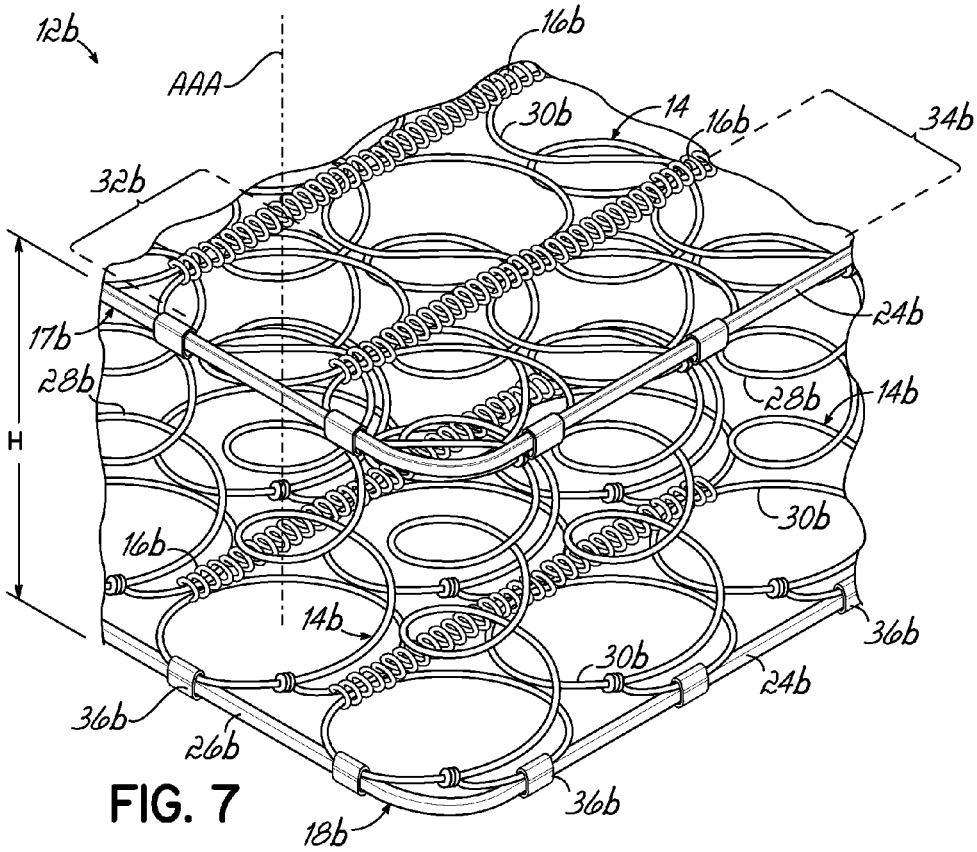
FIG. 7 is an enlarged perspective view of a portion of an alternative embodiment of spring core in accordance with the present invention.

FIG. 7 illustrates another embodiment of a two-sided spring assembly 12*b* having an upper border wire 17*b* and a lower border wire 18*b*, each configured and sized like the border wires 17, 18. Each of the coil springs 14*b* of spring core 12*b* is made of one piece of wire having a central spiral portion 28*b* defining a central spring axis AAA and terminating at opposed ends with upper and lower knotted end turns 30*b*. The coil springs 14*b* are arranged in side-by-side rows 32*b* and columns 34*b*. The coil springs 14*b* are connected with each other by helical lacing wires 16*b*. More particularly, the end turns 30*b* of the coil springs 14*b* are joined together using the helical lacing wires 16*b*, as is known in the art. Although the helical lacing wires 16*b* are shown as extending parallel the ends 24*b* of the border wires 17*h*, 18*b*, they may extend parallel the ends 26*b* of the border wires. In other words, different orientations of the coil springs and helical lacing wires within the spring core are possible within the scope of the present invention. As shown in FIG. 7, the upper and lower end turns 30*b* of the outermost coil springs 14*b* of the spring core 12*b* are clipped to the border wires 17*b*, 18*b* by clips 32*b* as described herein.

Figure 8:
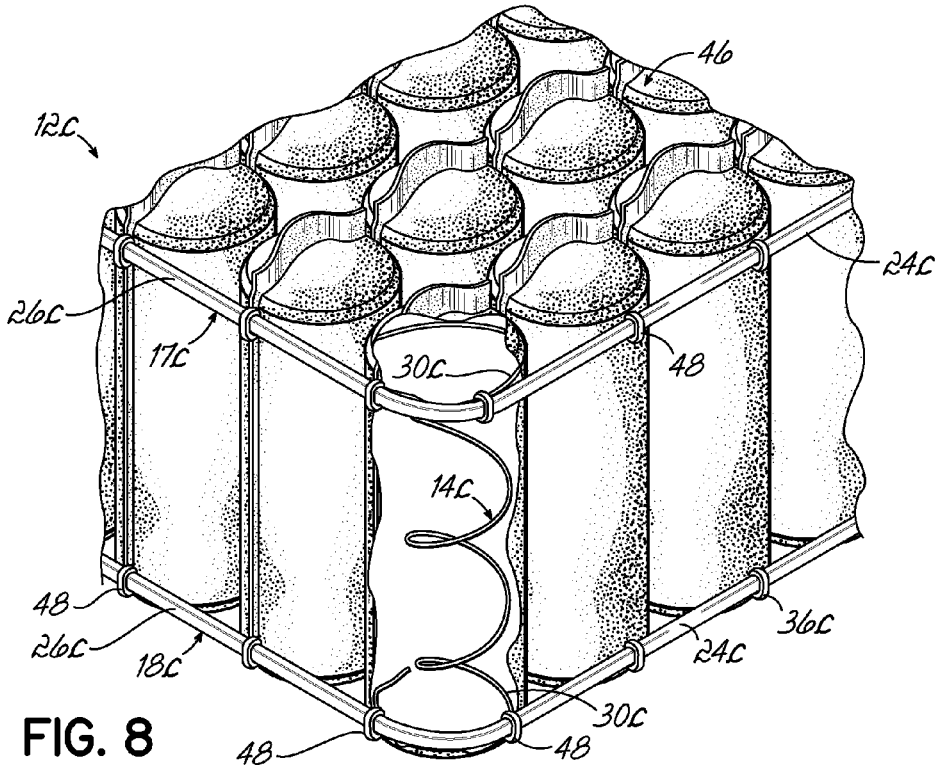
FIG. 8 is an enlarged perspective view of a portion of an alternative embodiment of spring core in accordance with the present invention.

FIG. 8 illustrates another embodiment of a two-sided spring assembly 12*c* having an upper border wire 17*c* and a lower border wire 18*c*, each configured and sized like the border wires 17, 18. The spring assembly 12*c* is a pocketed spring assembly comprising a plurality of parallel strings of springs 46 joined to each other. Each of the strings of springs 46 of spring core 12*c* comprises a row of individually pocketed springs, as is known in the art. Although the strings of springs 46 are shown as extending parallel, the ends 24*c* of the border wires 17*c*, 18*c*, they may extend parallel the ends 26*c* of the border wires. In other words, different orientations of the strings of springs within the pocketed spring core are possible within the scope of the present invention. Also any type of spring may be inside the individual pockets. As shown in FIG. 8, the upper and lower end turns 30*c* of the pocketed springs 14*c* of the spring core 12*c* are clipped to the border wires 17*c*, 18*c* by hog rings 48, as is known in the pocketed spring art.

One of ordinary skill in the art will readily recognize that the alternative embodiments of the mattress 10 shown herein are exemplary only of a wide variety of alternative configurations that are readily possible within the scope of this invention.

From the above disclosure of the general principles of the present invention, and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A bedding or seating product comprising:

a spring core made up of upper and lower border wires and a plurality of coil springs wherein each of the border wires has a generally rectangular cross-sectional configuration, each of the border wires having top and bottom surfaces defining a height of the border wire and side surfaces defining a width of the border wire, the height being greater than the width when the spring core is oriented such that the border wires are horizontal, each of the coil springs being made of a single piece of wire, each of said coil springs having a central spiral portion defining a central spring axis and terminating at opposed ends with an upper end turn and a lower end turn, the coil springs being arranged in side-by-side rows and columns and being connected with each other at the upper and lower end turns by helical lacing wires wherein the upper end turns of the outermost coil springs of said rows and columns are positioned below the upper border wire and the lower end turns of the outermost coil springs of said rows and columns are positioned above the lower border wire, the outermost springs of each of said rows and each of said columns being clipped to at least one of the border wires with a clip, each of the clips having two sides parallel the side surfaces of the border wire and two curved ends of different radiuses;

padding overlaying the spring core;

a fabric covering encasing the padding and spring core.

2. A bedding or seating product comprising:

a spring core made up of upper and lower border wires and a plurality of coil springs wherein each of the border wires has a generally rectangular cross-sectional configuration, each of the border wires having top and bottom surfaces defining a height of the border wire and side surfaces defining a width of the border wire, the height being greater than the width when the spring core is oriented such that the border wires are horizontal, each of the coil springs being made of a single piece of wire, each of the coil springs having a central spiral portion defining a central spring axis and terminating at opposed ends with an upper and a lower end turn, the coil springs being arranged in side-by-side rows and columns and being connected with each other at the upper and lower end turns by helical lacing wires wherein the upper end turns of the outermost coil springs of said rows and columns of springs are positioned below the upper border wire and the lower end turns of the outermost coil springs of said rows and columns of springs are positioned above the lower border wire, the outermost springs of each of said rows and each of said columns being clipped to at least one of the border wires with a clip, the clip having two sides parallel the side surfaces of the border wire and two curved ends of different radiuses.

3. The product of claim 2 wherein each of the border wires is made of seven-gauge wire.

4. The product of claim 2 wherein the cross-section of each of the border wires has rounded corners.

5. The product of claim 2 wherein the clips are made of metal.

6. The product of claim 2 wherein each of the border wires is made of a smaller diameter wire than a border wire having a circular cross-section having approximately the same beam strength, thereby enabling the spring core to be made using less material.

7. The product of claim 2 wherein the end turns of the coil springs are unknotted.

8. A bedding or seating product comprising:

a spring core made up of upper and lower border wires and a plurality of springs wherein each of the border wires has a generally rectangular cross-section having top and bottom surfaces defining a height of the border wire and side surfaces defining a width of the border wire, the height being greater than the width when the spring core is oriented such that the border wires are horizontal, each of the springs having a central spiral portion defining a central spring axis and terminating at opposed ends with an unknotted upper end turn and a lower end turn, the springs being arranged in side-by-side rows and columns and being connected with each other by helical lacing wires, the upper and lower end turns of at least some of the springs being clipped to the upper and lower border wires, respectively, by clips, each of the clips having two sides parallel the side surfaces of the border wire inside the clip and two curved ends of different radiuses, the upper end turns of at least some of the springs being positioned below the upper border wire and the lower end turns of at least some of the springs being positioned above the lower border wire.

9. The product of claim 8 wherein the springs are coil springs.

10. The product of claim 8 wherein each of the border wires is made of seven-gauge wire.

11. The product of claim 8 wherein the cross-section of each of the border wires has rounded corners.

12. The product of claim 8 wherein each of the springs is made of a single piece of wire.

13. The product of claim 12 wherein the springs are connected with each other at the upper and lower end turns by helical lacing wires.

14. A bedding or seating product comprising:

a spring core made up of a plurality of coil springs and upper and lower border wires, each of the border wires having a generally rectangular cross-sectional configuration including a height defined as the linear distance between top and bottom surfaces of the border wire and a width defined as the linear distance between opposed side surfaces of the border wire, the height being greater than the width when the spring core is oriented such that the border wires are horizontal, each of the coil springs having a central spiral portion defining a central spring axis and terminating at opposed ends with an upper end turn and a lower end turn, the coil springs being arranged in side-by-side rows and columns and being connected with each other at the upper and lower end turns by helical lacing wires, each of the springs around the perimeter of the spring core being secured to at least one of the border wires with a clip, the clip having two sides parallel the side surfaces of the border wire and two curved ends of different radiuses.

15. The product of claim 14 wherein each of the border wires is made of a smaller diameter wire than a border wire having a circular cross-section having approximately the same beam strength, thereby enabling the spring core to be made using less material.

16. The product of claim 14 wherein each of the border wires is made of seven-gauge wire.

17. The product of claim 14 wherein the cross-section of each of the border wires has rounded corners.

18. The product of claim 14 wherein the clips are made of metal.

19. The product of claim 14, wherein the end turns of the coil springs are unknotted.

* * * * *